US009725985B2

(12) United States Patent
McNamee et al.

(10) Patent No.: US 9,725,985 B2
(45) Date of Patent: Aug. 8, 2017

(54) INFLOW CONTROL DEVICE HAVING EXTERNALLY CONFIGURABLE FLOW PORTS

(75) Inventors: Stephen McNamee, Rhode (IE); John S. Sladic, Katy, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 614 days.

(21) Appl. No.: 13/485,463

(22) Filed: May 31, 2012

(65) Prior Publication Data

US 2013/0319664 A1 Dec. 5, 2013

(51) Int. Cl.

| | |
|---|---|
| ***E21B 34/08*** | (2006.01) |
| ***E21B 43/08*** | (2006.01) |
| ***E21B 43/12*** | (2006.01) |

(52) U.S. Cl.

CPC ..... *E21B 34/08* (2013.01); *E21B 43/08* (2013.01); *E21B 43/12* (2013.01)

(58) Field of Classification Search

CPC ..... E21B 43/12; E21B 34/00; E21B 34/06; E21B 34/08; E21B 43/08

USPC ..... 166/373, 216–334.4, 330, 332.1–332.3, 166/332.8, 378, 380

See application file for complete search history.

(56) References Cited

U.S. PATENT DOCUMENTS

| | | | | |
|---|---|---|---|---|
| 3,095,007 | A * | 6/1963 | Allen | 137/330 |
| 5,435,393 | A | 7/1995 | Brekke et al. | |
| 5,803,179 | A | 9/1998 | Echols et al. | |
| 6,371,210 | B1 | 4/2002 | Bode et al. | |
| 6,644,412 | B2 | 11/2003 | Bode et al. | |
| 6,715,544 | B2 | 4/2004 | Gillespie et al. | |
| 6,883,613 | B2 | 4/2005 | Bode et al. | |
| 7,240,739 | B2 | 7/2007 | Schoonderbeek et al. | |
| 7,428,924 | B2 | 9/2008 | Patel | |
| 7,469,743 | B2 | 12/2008 | Richards | |
| 7,578,343 | B2 | 8/2009 | Augustine | |
| 7,708,068 | B2 | 5/2010 | Hailey, Jr. | |
| 7,717,178 | B2 | 5/2010 | Gaudette et al. | |
| 7,987,909 | B2 | 8/2011 | Pineda et al. | |
| 2002/0108755 | A1 | 8/2002 | Zisk | |
| 2002/0157837 | A1 | 10/2002 | Bode et al. | |

(Continued)

FOREIGN PATENT DOCUMENTS

| | | |
|---|---|---|
| AU | 672983 | 3/1994 |
| CA | 2762480 A1 | 6/2013 |

(Continued)

OTHER PUBLICATIONS

For the American Heritage Dictionary definition: sealing. (n.d.) American Heritage® Dictionary of the English Language, Fifth Edition. (2011). Retrieved Jan. 26, 2016 from http://www.thefreedictionary.com/sealing.*

(Continued)

*Primary Examiner* — Wei Wang
(74) *Attorney, Agent, or Firm* — Blank Rome LLP

(57) ABSTRACT

A completion joint 100 has a sand control jacket 120 and an inflow control device 130. The jacket 120 communicates screened fluid with a housing of the inflow control device 130. The basepipe's flow openings 118 are isolated in the housing from the screened fluid by flow devices 170. The flow devices 170 are externally accessible on the device's housing to selectively configure the flow devices 170 open or closed.

35 Claims, 12 Drawing Sheets

(56) References Cited

U.S. PATENT DOCUMENTS

| | | | | |
|---|---|---|---|---|
| 2004/0108107 | A1 | 6/2004 | Wittrisch | |
| 2004/0154806 | A1 | 8/2004 | Bode et al. | |
| 2007/0012453 | A1 | 1/2007 | Coronado et al. | |
| 2007/0246212 | A1 | 10/2007 | Richards | |
| 2007/0246407 | A1 | 10/2007 | Richards et al. | |
| 2008/0041588 | A1 | 2/2008 | Richards et al. | |
| 2008/0169099 | A1 * | 7/2008 | Pensgaard | 166/285 |
| 2008/0236843 | A1 | 10/2008 | Scott et al. | |
| 2008/0314590 | A1 | 12/2008 | Patel | |
| 2009/0000787 | A1 | 1/2009 | Hill et al. | |
| 2009/0008092 | A1 | 1/2009 | Haeberle et al. | |
| 2009/0050313 | A1 | 2/2009 | Augustine | |
| 2009/0151925 | A1 | 6/2009 | Richards et al. | |
| 2010/0212895 | A1 | 8/2010 | Vickery et al. | |
| 2011/0073308 | A1 | 3/2011 | Assal et al. | |
| 2011/0147006 | A1 | 6/2011 | O'Malley et al. | |
| 2011/0180271 | A1 | 7/2011 | Brekke | |
| 2012/0006563 | A1 | 1/2012 | Patel et al. | |
| 2012/0061088 | A1 | 3/2012 | Dykstra et al. | |
| 2015/0013978 | A1 | 1/2015 | Nenniger | |

FOREIGN PATENT DOCUMENTS

| | | | | |
|---|---|---|---|---|
| CN | 101255787 | A | 9/2008 | |
| CN | 201236678 | | 5/2009 | |
| EP | 0588421 | A1 | 3/1994 | |
| EP | 1407806 | A1 | 4/2004 | |
| EP | 1672167 | A1 | 6/2006 | |
| GB | 2410762 | A | 10/2005 | |
| GB | 2437641 | A | 10/2007 | |
| GB | 2450589 | A | 12/2008 | |
| WO | 9208875 | | 5/1992 | |
| WO | 2005/071221 | A1 | 8/2005 | |
| WO | 2009103036 | | 8/2009 | |
| WO | 2011/106579 | A2 | 9/2011 | |
| WO | WO 2013022446 | A1 * | 2/2013 | E21B 34/06 |

OTHER PUBLICATIONS

Cesari, Michele, "Water/Gas Breakthrough in Horizontal Wells Analysis of the completion strategies used to mitigate the problem," Master in Petroleum Engineering Sep. 2008, Oct. 21, 2009, 43 pages.

Schlumberger, "Inflow Control Devices-Raising Profiles," Oilfield Review, Winter 2009/2010, vol. 4, pp. 30-37.

Baker Hughes, "Equalizer-CF Completion Solution Reduced Pay Zone Losses in Mature Field," obtained from www.bakerhughes.com, (c) 2010, 1 page.

Aadnoy, Bernt S, "Autonomous Flow Control Valve or "intelligent" ICD," (c) 2008, 9 pages.

Birchenko, Vasily Mihailovich, "Analytical Modelling of Wells with Inflow Control Devices," Jul. 2010, pp. 1-134, Institute of Petroleum Engineering Heriot-Watt University.

Halliburton, "EquiFlow Inflow Control Devices and EquiFlow Inject System," obtained from www.halliburton.com, (c) 2009, 18 pages.

Halliburton, "EquiFlow Autonomous Inflow Control Device," obtained from www.halliburton.com, (c) 2011, 22 pages.

Weatherford, "Combating Coning by Creating Even Flow Distribution in Horizontal Sand-Control Completions," obtained from www.weatherford.com, (c) 2005-2008, 4 pages.

Schlumberger, "FloRite Inflow Control Device," obtained from www.slb.com/transcend, (c) 2009, 2 pages.

Schlumberger, "FluxRite Inflow Control Device," obtained from www.slb.com/completions, (c) 2009, 2 pages.

Halliburton, "EquiFlow Inflow Control Devices," Advanced Completions, obtained from www.halliburton.com, (c) 2009, 2 pages.

Halliburton, "EquiFlow Inject System," Advanced Completions, obtained from www.halliburton.com, (c) 2009, 2 pages.

Halliburton, "PetroGuard Mesh Screen," Sand Control Screens, obtained from www.halliburton.com, (c) 2010, 2 pages.

Halliburton, "EquiFlow Sliding Side-Door Inflow Control Device," Advanced Completions, obtained from www.halliburton.com, (c) 2011, 2 pages.

Halliburton, "PetroGuard Screen and EquiFlow ICD with Remote-Open Valve" Advanced Completions, obtained from www.halliburton.com, (c) 2011, 2 pages.

The Journal of Petroleum Technology, "Novel inflow-control device extends well life," obtained from www.spe.org/jpt/2009/05/novel-inflow-control-device-extends-well-life/, May 18, 2009, 2 pages.

Schlumberger, "ResFlow Well Production Management System," obtained from www.slb.com/completions, (c) 2007, 4 pages.

Schlumberger, "ResInject Well Production Management System," obtained from www.slb.com/completions, (c) 2007, 2 pages.

Schlumberger, "Reslink-Screens and Injection and Inflow Control Devices," obtained from www.slb.com/transcend, (c) 2007, 8 pages.

Weatherford, "Retarding Water Production: Nozzle V's Channel ICD's," Jun. 30, 2009, 22 pages.

Weatherford, "Maxflo Screen with FloReg Device Improves Production by Achieving Even Flow Distribution in Offshore Openhole Well" obtained from www.weatherford.com, (c) 2008, 1 page.

Torbergsen,Hans-Emil Bensnes, "Application and Design of Passive Inflow Control Devices on the Eni Goliat Oil Producer Wells," Oct. 12, 2012, 138 pages, University of Stavanger, Faculty of Science and Technology.

Weatherford, "Maximizing Well Recovery by Creating Even Flow Distribution in Horizontal and Deviated Openhole Completions," obtained from www.weatherford.com, (c) 2005-2009, 4 pages.

Weatherford, "Conventional Well Screens," obtained from www.weatherford.com, (c) 2004-2009, pp. 1-15.

Weatherford, "Intermittent Production Now Flowing Steady with FloReg Inflow Control Devices," obtained from www.weatherford.com, (c) 2007-2008, 1 page.

Weatherford, "Well Screen Technologies," obtained from www.weatherford.com, (c) 2008, 12 pages.

Written Opinion in counterpart Singapore Appl. 201304028-2, dated Feb. 28, 2014.

First Office Action in counterpart Canadian Appl. 2,816,646, dated Oct. 16, 2014.

First Examination Report in counterpart Australian Appl. 2013206044, dated Feb. 19, 2015.

Second Written Opinion in counterpart Singapore Appl. 201304028-2, dated Feb. 13, 2015.

Notice of Acceptance in counterpart Australian Appl. 2013206044, dated Sep. 17, 2015.

Notice of Allowance in counterpart Canadian Appl. 2,816,646, dated Jul. 13, 2015.

First Office Action in counterpart Chinese Appl. 201310209953.4, dated May 25, 2015.

Examination Report in counterpart Singapore Appl. 2013040282, dated Aug. 2, 2015.

Second Office Action in counterpart Chinese Appl. 201310209953.4, dated Dec. 29, 2015.

Extended Search Report in counterpart EP Appl. 13169909.2, dated Dec. 15, 2015.

* cited by examiner

INFLOW CONTROL DEVICE HAVING EXTERNALLY CONFIGURABLE FLOW PORTS

BACKGROUND OF THE DISCLOSURE

In unconsolidated formations, horizontal and deviated wells are normally completed with completion systems having integrated sand screens. To control the flow of produced fluids, the sand screens may use inflow control devices (ICD)—one example of which is disclosed in U.S. Pat. No. 5,435,393 to Brekke et al. Other examples of inflow control devices are also available, including the FloReg ICD available from Weatherford International, the Equalizer® ICD available from Baker Hughes, ResFlow ICD available from Schlumberger, and the EquiFlow® ICD available from Halliburton. (EQUALIZER is a registered trademark of Baker Hughes Incorporated, and EQUIFLOW is a registered trademark of Halliburton Energy Services, Inc.)

For example, a completion system 10 in FIG. 1 has completion screen joints 50 deployed on a completion string 14 in a borehole 12. Typically, these screen joints 50 are used for horizontal and deviated boreholes passing in an unconsolidated formation as noted above, and packers 16 or other isolation elements can be used between the various joints 50. During production, fluid produced from the borehole 12 directs through the screen joints 50 and up the completion string 14 to the surface rig 18. The screen joints 50 keep out fines and other particulates in the produced fluid. In this way, the screen joints 50 can mitigate damage to components, mud caking in the completion system 10, and other problems associated with fines and particulate present in the produced fluid.

Turning to FIGS. 2A-2C, the prior art completion screen joint 50 is shown in a side view, a partial side cross-sectional view, and a detailed view. The screen joint 50 has a basepipe 52 with a sand control jacket 60 and an inflow control device 70 disposed thereon. The basepipe 52 defines a through-bore 55 and has a coupling crossover 56 at one end for connecting to another joint or the like. The other end 54 can connect to a crossover (not shown) of another joint on the completion string. Inside the through-bore 55, the basepipe 52 defines pipe ports 58 where the inflow control device 70 is disposed.

The joint 50 is deployed on a production string (14: FIG. 1) with the screen 60 typically mounted upstream of the inflow control device 70. Here, the inflow control device 70 is similar to the FloReg Inflow Control Device (ICD) available from Weatherford International. As best shown in FIG. 2C, the device 70 has an outer sleeve 72 disposed about the basepipe 52 at the location of the pipe ports 58. A first end-ring 74 seals to the basepipe 52 with a seal element 75, and a second end-ring 76 attaches to the end of the screen 60. Overall, the sleeve 72 defines an annular space around the basepipe 52 that communicates the pipe ports 58 with the sand control jacket 60. The second end-ring 76 has flow ports 80, which separate the sleeve's inner space 86 from the screen 60.

For its part, the sand control jacket 60 is disposed around the outside of the basepipe 52. As shown, the sand control jacket 60 can be a wire wrapped screen having rods or ribs 64 arranged longitudinally along the base pipe 52 with windings of wire 62 wrapped thereabout to form various slots. Fluid from the surrounding borehole annulus can pass through the annular gaps and travel between the sand control jacket 60 and the basepipe 52.

Internally, the inflow control device 70 has nozzles 82 disposed in flow ports 80. The nozzles 82 restrict the flow of screened fluid from the screen jacket 60 into the device's inner space 86 and produce a pressure drop in the fluid. For example, the inflow control device 70 can have ten nozzles 82. Operators set a number of these nozzles 82 open at the surface to configure the device 70 for use downhole in a given implementation. In this way, the device 70 can produce a configurable pressure drop along the screen jacket 60 depending on the number of open nozzles 82.

To configure the device 70, pins 84 can be selectively placed in the passages of the nozzles 82 to close them off. The pins 84 are typically hammered in place with a tight interference fit and are removed by gripping the pin 84 with a vice grip and then hammering on the vice grip to force the pin 84 out of the nozzle 82. These operations need to be performed off rig beforehand so that valuable rig time is not used up. Thus, operators must predetermine how the inflow control devices 70 are to be preconfigured and deployed downhole before setting up the components for the rig.

When the joints 50 are used in a horizontal or deviated borehole of a well as shown in FIG. 1, the inflow control devices 70 are configured to produce particular pressure drops to help evenly distribute the flow along the completion string 14 and prevent coning of water in the heel section. Overall, the devices 70 choke production to create an even-flowing pressure-drop profile along the length of the horizontal or deviated section of the borehole 12.

Although the inflow control device 70 of the prior art is effective, it is desirable to be able to configure the pressure drop for a borehole accurately to meet the needs of a given installation and to be able to easily configure the pressure drop as needed.

The subject matter of the present disclosure is, therefore, directed to overcoming, or at least reducing the effects of, one or more of the problems set forth above.

SUMMARY OF THE DISCLOSURE

A sand control apparatus, which can be a joint for a completion string, has a basepipe with a bore for conveying the production fluid to the surface. To prevent sand and other fines from passing through openings in the basepipe to the bore, a screen can be disposed on the basepipe for screening fluid produced from the surrounding borehole, although a screen may not be always used. Disposed on the basepipe, a housing defines a housing chamber in fluid communication with screened fluid from the screen. During production, fluid passes through the screen, enters the housing chamber, and eventually passes into the basepipe's bore through the pipe's openings.

To control the flow of the fluid and create a desired pressure drop for even-flow along the screen joint, a flow device disposed on the joint controls fluid communication from the housing's chamber to the openings in the basepipe. In one implementation, the flow device includes one or more flow ports having nozzles. A number of the flow ports and nozzles may be provided to control fluid communication for a particular implementation, and the nozzles can be configured to allow flow or to prevent flow by use of a pin, for example.

To configure the number of nozzles that will permit flow, the flow devices are externally configurable on the housing to selectively control fluid communication from the screen to the pipe's openings. For example, each of the flow devices is configurable between open and closed states. To configure the flow devices, they can be accessed externally without the need to remove housing components or the like.

In the open state, the flow device permits fluid flow between the screen and at least one of the openings. As will be appreciated, this open state can be a fully open state or a partially open state depending on the flow device. In the closed state, the flow device prevents fluid flow between the screen and the at least one opening. Again, this closed state can be a fully closed or a partially closed state. In general, the flow devices can be configurable between at least two states and may have any number of intermediate states if desired.

In one example, the flow device is a valve disposed in the housing. The valve can be a ball valve having an orifice defined therein. A spindle of the ball valve is externally accessible on the housing so turning of the ball valve can orient the orifice to the open or closed state.

In another example, the flow device can be a stopper externally insertable into the housing relative to a flow port. The stopper can be a pin or plug threading into an external opening in the housing so that a portion of the stopper inserts in the flow port and closes off fluid communication therethrough. To configure the flow port open, the flow device uses a cap that attaches to the external opening in the housing instead of the stopper. When the cap is attached to the housing, it closes off fluid communication of the flow port out of the external opening, but flow can still pass through the housing's flow port.

The flow ports of the inflow control device can use nozzles in which a portion of the stopper, pin, or plug inserts to close of fluid flow through the flow ports. In addition to nozzles used in flow ports, the flow devices can use other features to restrict flow and produce a desired pressure drop, including tubes, capillaries, valve mechanisms, convoluted channels, tortuous pathways, etc.

The foregoing summary is not intended to summarize each potential embodiment or every aspect of the present disclosure.

DETAILED DESCRIPTION OF THE DISCLOSURE

Figure 2A:
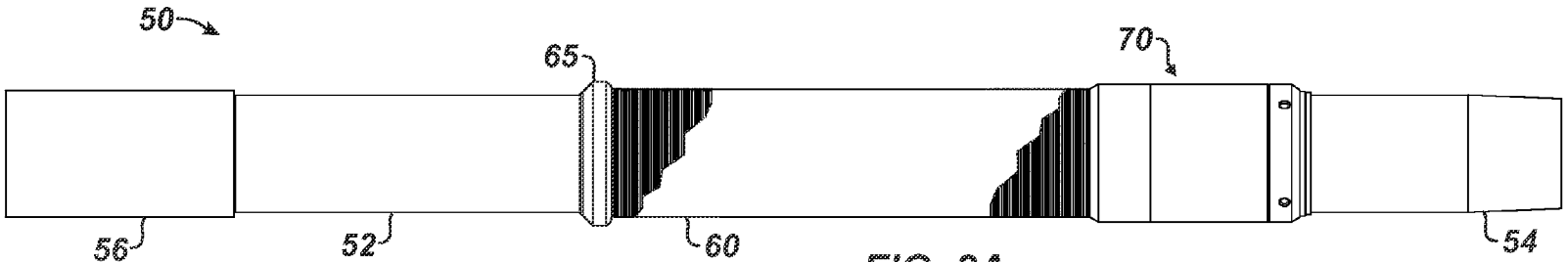
FIG. 2A (Prior Art)
FIG. 2A illustrates a completion screen joint according to the prior art.
Figure 2B:
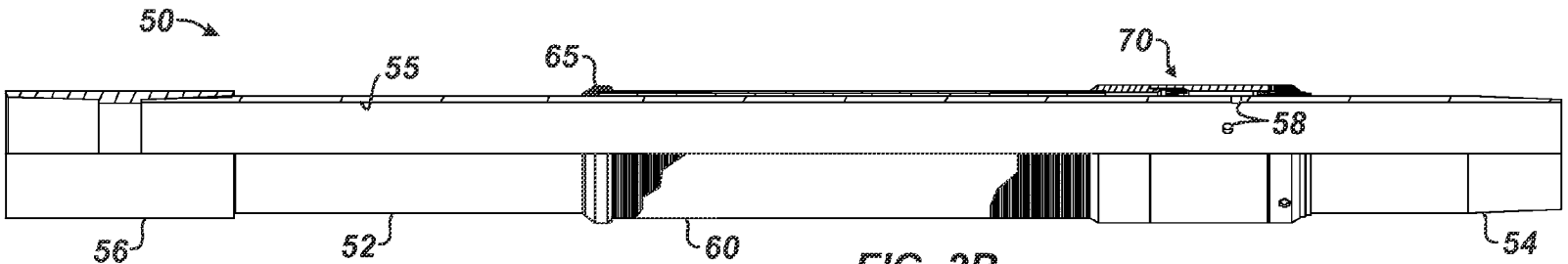
FIG. 2B (Prior Art)
FIG. 2B illustrates the prior art completion screen joint in partial cross-section.
Figure 2C:
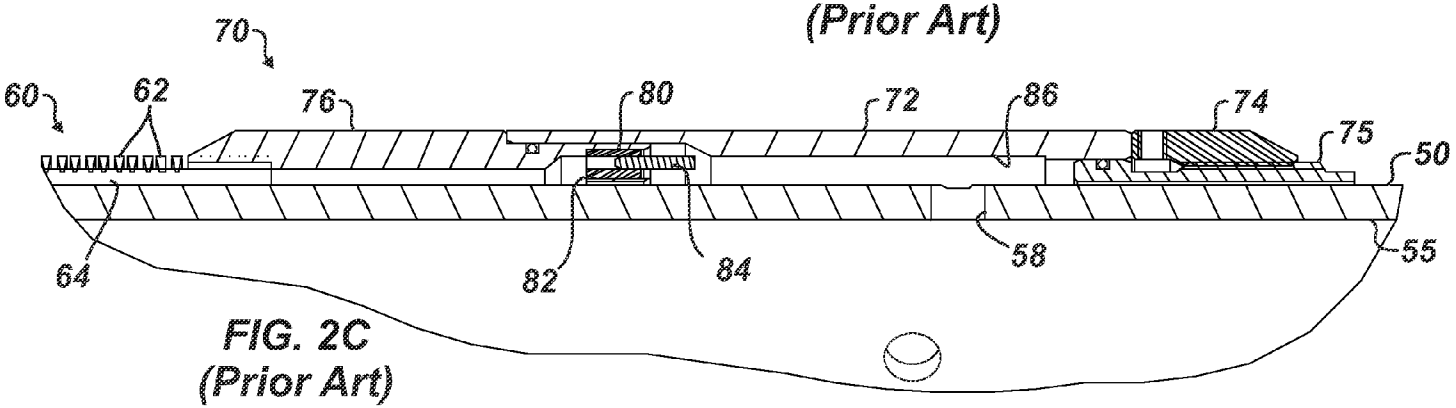
FIG. 2C (Prior Art)
FIG. 2C illustrates a detail on an inflow control device for the prior art completion screen joint.

As discussed above with reference to FIGS. 2A-2C, the prior art inflow control device 70 has to be disassembled and opened up so operators can configure the flow ports open or closed by hammering in or pulling pins from the ports. Then, the device 70 needs to be reassembled so it can be used.

A completion screen joint 100 of the present disclosure shown in FIGS. 3A-3E can overcome the limitations of the prior art completion screen joint. The joint 100 is shown in a side view in FIG. 3A, a partial cross-sectional view in FIG. 3B, a detailed view in FIG. 3C, a partial perspective view in FIG. 3D, and an end-sectional view in FIG. 3E. This completion screen joint 100 can be used in a completion system, such as described above with reference to FIG. 1, so that the details are not repeated here.

For this completion screen joint 100, an inflow control device 130 is mounted on a basepipe 110 and communicates with a sand control jacket or screen 120. The basepipe 110 defines a through-bore 115 for conveying produced fluid and defines flow openings 118 for conducting produced fluid from outside the basepipe 110 into the bore 115. To connect the joint 100 to other components of a completion system, the basepipe 110 has a coupling crossover 116 at one end, while the other end 114 can connect to a crossover (not shown) of another basepipe.

For its part, the sand control jacket 120 disposed around the outside of the basepipe 110 uses any of the various types of screen assemblies known and used in the art so that the flow characteristics and the screening capabilities of the joint 100 can be selectively configured for a particular implementation. In general, the screen jacket 120 can comprise one or more layers, including wire wrappings, porous metal fiber, sintered laminate, pre-packed media, etc.

Figure 3A:
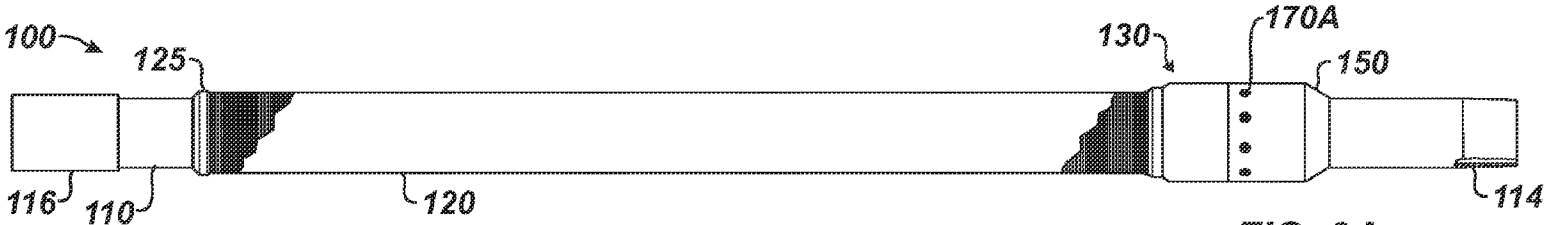
FIG. 3A illustrates a completion screen joint having an inflow control device according to the present disclosure.
Figure 3B:
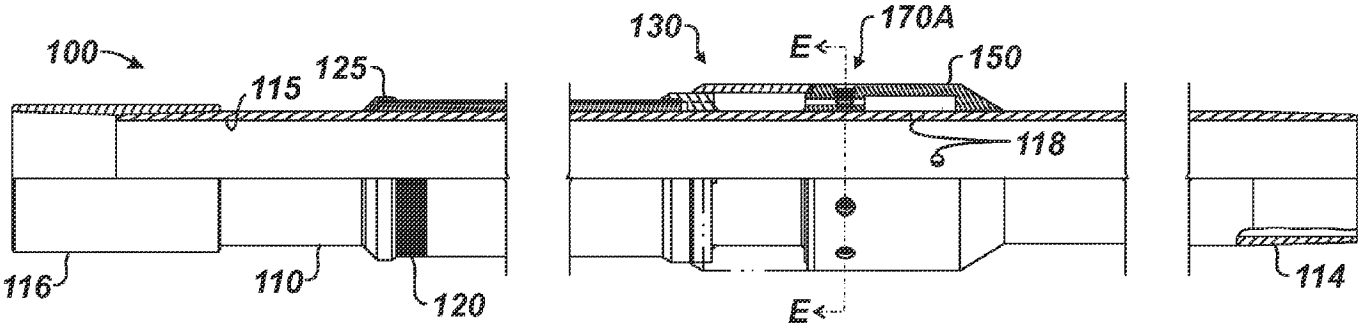
FIG. 3B illustrates the disclosed completion screen joint in partial cross-section.
Figure 3C:
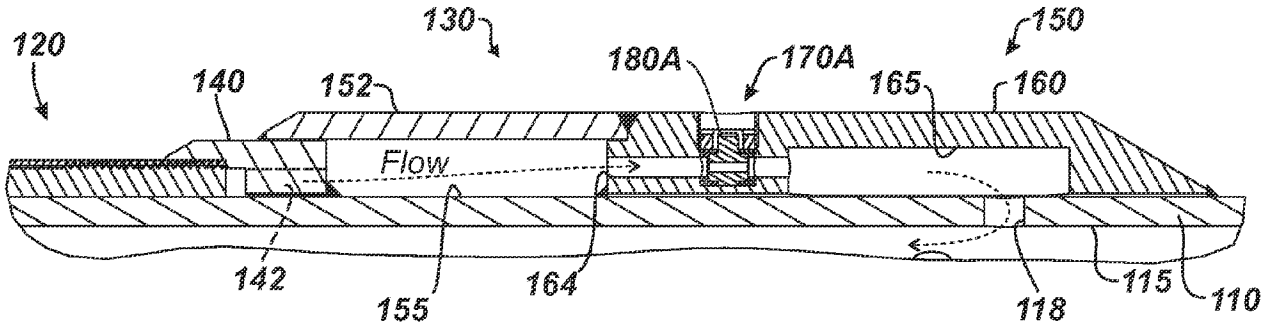
FIG. 3C illustrates a detail of the disclosed inflow control device.

As shown in FIGS. 3A-3C, for example, the jacket 120 can be a wire-wrapped screen having rods or ribs 124 arranged longitudinally along the basepipe 110 with windings of wire 122 wrapped thereabout. The wire 122 forms various slots for screening produced fluid, and the longitudinal ribs 124 create channels that operate as a drainage layer. Other types of screen assemblies can be used for the jacket 120, including metal mesh screens, pre-packed screens, protective shell screens, expandable sand screens, or screens of other construction.

During production, fluid from the surrounding borehole annulus can pass into the sand control jacket 120 and can pass along the annular gap between the sand control jacket 120 and the basepipe 110. An outside edge of the screen jacket 120 has a closed end-ring 125, preventing screened fluid from passing. Instead, the screened fluid in the gap of the jacket 120 and the basepipe 110 passes to an open end-ring 140 to enter the inflow control device 130 disposed on the basepipe 110.

The inflow control device 130 is disposed on the basepipe 110 at the location of the flow openings 118. As best shown in FIG. 3C, the inflow control device 130 has an open end-ring 140 (noted above) that abuts the inside edge of the screen jacket 120 and a housing 150 is disposed next to the end-ring 140.

The housing 150 has a cylindrical sleeve 152 and a flow ring 160 disposed about the basepipe 110. The cylindrical sleeve 152 is supported on the end-ring 140 and the flow ring 160 to enclose a housing chamber 155. For this assembly, the sleeve 152 affixes to the end ring 140 and the flow ring 160, and the end-ring 140 and the flow ring 160 affix to the basepipe 110. In this way, the inflow control device 130 can be permanently affixed to the basepipe 110, and no O-rings or other seal elements are needed for the housing 150. This form of construction can improve the longevity of the device 130 when deployed downhole.

Being open, the end-ring 140 has internal channels, slots, or passages 142 that can fit partially over the inside edges of the jacket 120 as shown in FIG. 3C. During use, these passages 142 allow fluid screened by the jacket 120 to communicate through the open end-ring 140 to the housing chamber 155. As also shown in the exposed perspective of FIG. 3D, walls or dividers 144 between the passages 142 support the open end-ring 140 on the basepipe 110 and can be attached to the pipe's outside surface during manufacture. It will be appreciated that the open end-ring 140 can be configured in other ways with openings to allow fluid flow therethrough.

Figure 3D:
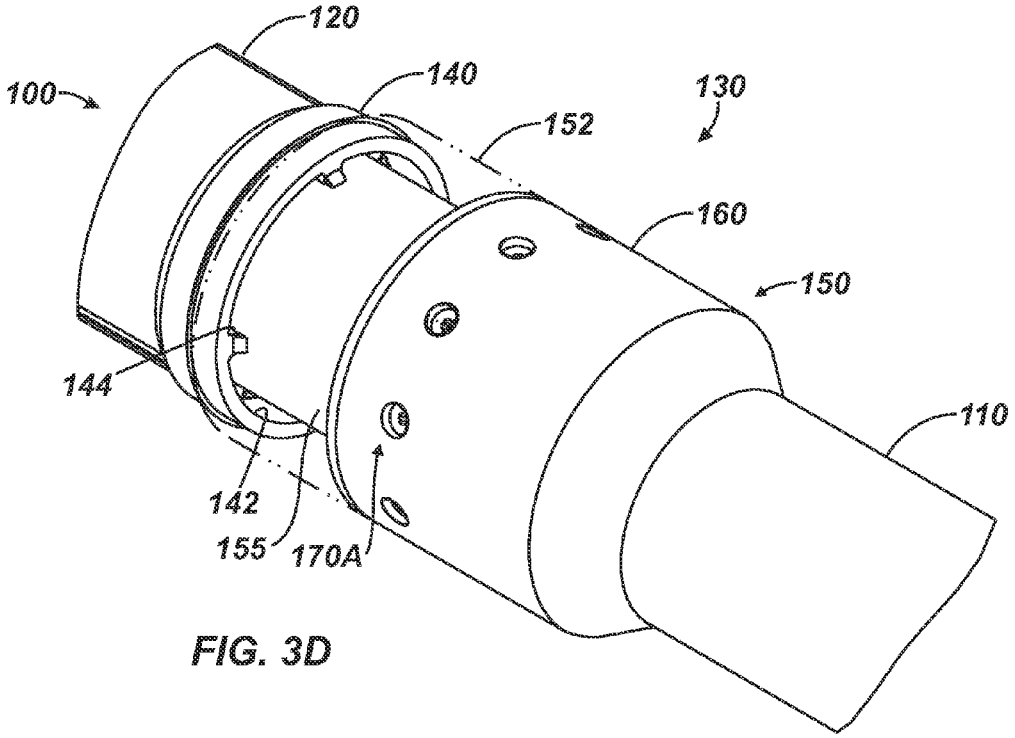
FIG. 3D illustrates a perspective view of a portion of the disclosed completion screen joint.
Figure 3E:
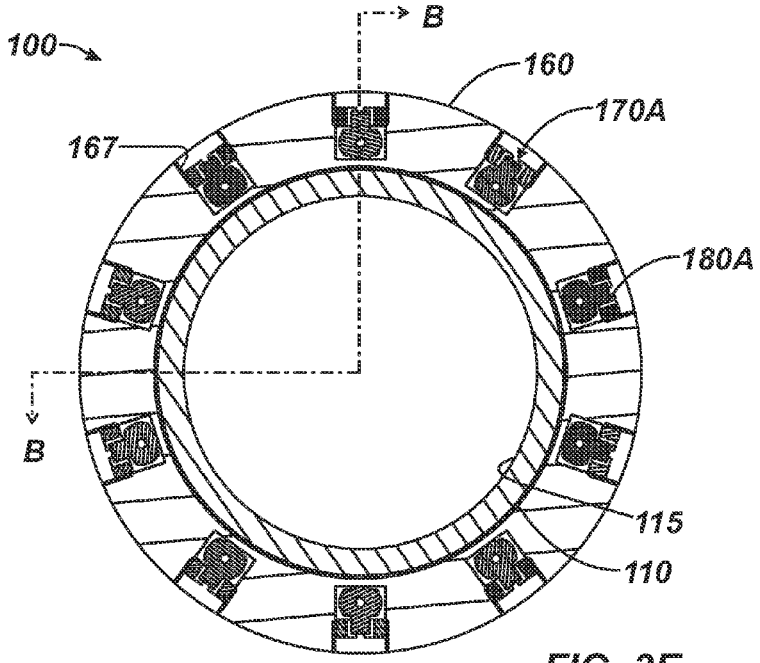
FIG. 3E illustrates an end-section of the disclosed completion screen joint taken along line E-E of FIG. 3B.

FIGS. 3D-3E reveal additional details of the flow ring 160 and show how flow of screened fluid (i.e., inflow) can reach the pipe's openings 118. Flow ports 164 defined in the flow ring 160 communicate with one or more inner chambers (165: FIG. 3C) of the ring 160. In turn, the one or more inner chambers 165 communicate with the pipe's openings 118.

During operation, for example, screened fluid from the screen jacket 120 can commingle in the housing's chamber 155. In turn, each of the flow ports 164 can communicate the commingled screened fluid from the housing chamber 155 to the one or more inner chambers 165, which communicate the fluid with the basepipe's openings 118.

To configure how screened fluid can enter the basepipe 110 through the openings 118, the flow ring 160 has one or more flow devices 170A that restrict flow of screened fluid from the housing chamber 155 to the pipe's openings 118. In general, the flow devices 170A can include a flow port, a constricted orifice, a nozzle, a tube, a syphon, or other such flow feature that controls and restricts fluid flow. Here, each of the flow devices 170A includes the flow ports 164 in the flow ring 160, and each port 164 preferably has an adjustable valve 180A. (Although all of the ports 164 have a valve 180A, only one or more may have a valve 180A while other ports 164 may have permanently open nozzles or the like.) Together or separately, the ports 164 and the valves 180A restrict flow of screened fluid and produce a pressure drop across the flow device 170A to achieve the purposes discussed herein.

Details of one of the flow devices 170A in the flow ring 160 are shown in FIG. 3C. The flow port 164 restricts passage of the screened fluid from the housing chamber 155 to the one or more inner chambers 165 associated with the flow port 164. This inner chamber 165 is essentially a pocket defined in the inside surface of the flow ring 160 and allows flow from the flow port 164 to communicate with the pipe's openings 118. The pocket chamber 165 may or may not communicate with one or more of the flow ports 164, and in the current arrangement, the chambers 165 do not communicate with each other. Other configurations are also possible.

Figure 4:
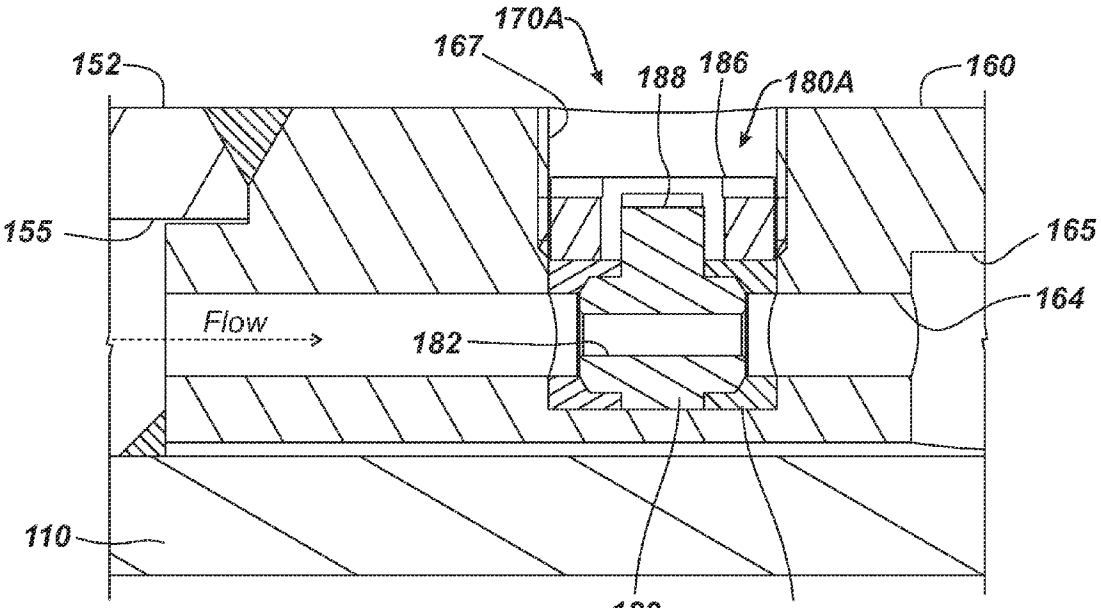
FIG. 4 illustrates a detail of the externally configurable flow device for the disclosed inflow control device.

The adjustable valves 180A can be accessed via an external opening 167 in the flow ring 160 to open or close passage of fluid through the flow ports 164. Details of the valve 180A are shown in FIG. 4. The valve 180A is a ball-type valve having a ball body 180 that fits down in the external opening 167 of the flow ring 160 and interposes between the ends of the flow port 164. Preferably, the ball valve 180A is composed of an erosion-resistant material, such as tungsten carbide, to prevent flow-induced erosion. Seal elements 184 can engage around the ball valve 180A to seal fluid flow around it, and the spindle 181 of the ball valve 180A can extend beyond a retainer 186 threaded or otherwise affixed in the external opening 167 of the flow ring 160 to hold the ball valve 180A. The seal elements 184 can be composed of polymer or other suitable material.

The exposed spindle 181 can be accessed with a tool (e.g., flat head screwdriver, Allen wrench, or the like) externally on the flow ring (160) so the ball valve 180A can be turned open or closed without needing to open or remove portions of the housing 150. This turning either orients an orifice 182 in the ball valve 180A with the flow port 164 or not. In general, quarter turns may be all that is needed to fully open and close the valves 180A. Partial turns may be used to open and close the valves 180A in intermediate states for partially restricting flow if desired.

When the valve 180A is fully closed and the orifice 182 does not communicate with the flow port 164, fluid flow does not pass through the flow port 164 to the pipe's opening 118. When the valve 180A is (fully or at least partially) open, the flow through the flow port 164 passes through the orifice 182 to the pipe's opening 118 so the flow can enter the pipe's bore 115. The orifice 182 in the open ball valve 180A can act as a flow nozzle to restrict the flow in addition to any flow restriction provided by the flow port 164 itself. Thus, the internal diameter of the orifice 182 can be sized as needed for the particular fluids to be encountered and the pressure drop to be produced.

To configure the inflow control device 130 of FIGS. 3A through 4, a set number of valves 180A are opened by turning a desired number of the valves 180A to the open position. Other valves 180A are turned to the closed position. By configuring the number of flow devices 170A having open valves 180A, operators can configure the inflow control device 130 to produce a particular pressure drop needed in a given implementation.

As an example, the flow ring 160 can have several (e.g., ten) flow devices 170A, although they all may not be open during a given deployment. In this way, operators can configure flow through the inflow control device 130 to the basepipe's openings 118 through any of one to ten open flow devices 170A so the inflow control device 130 allows for less inflow and can produce a configurable pressure drop along the screen jacket 120. If one valve 180A is open, the inflow control device 130 can produce an increasing pressure drop across the device 130 with an increasing flow rate. The more valves 180A that are opened, the more inflow that is possible, but the less markedly will the device 130 exhibit an increase in pressure drop relative to an increase in flow rate.

Of the various flow devices 170A disposed around the inflow control device 130, the orifices 182 of some of the devices 170A may define a certain flow area, diameter, or other flow restrictive characteristic that is different from the orifices of the other devices 170A. For example, a first half of the flow devices 170A may have orifices 182 with a first size. The second half of the flow devices 170A, preferably alternatingly arranged, may have orifices 182 with a second, smaller size. Thus, opening the first half of the flow devices 170A while the second half remain closed can configure a first flow profile, opening the second half of the flow devices 170A while the first half remain closed can configure a second flow profile, and opening all of the flow devices 170A can configure a third flow profile. Likewise, opening different ones of the various flow devices 170A can produce additional flow profiles.

Moreover, because the flow devices 170A disclosed herein can install in external openings 167 and be held by a retainer 186 or the like, operators can switch out the various flow devices 170A and select those having a particular flow area, diameter, or other flow restrictive characteristic. This interchangeable nature of the flow devices 170A gives operators an additional ability to configure the inflow control device 130 for a particular implementation.

In contrast to the conventional practice of disassembling inflow control devices, configuring nozzles open or closed with hammered pins, reassembling the devices, and then carefully arranging the devices for deployment at the rig, the current inflow control device 130 having the externally configurable flow devices 170A that can be accessed outside the housing 150 can reduce the number of assembly steps, save time, and avoid possible errors. Moreover, operators at the rig have more flexibility when deploying the inflow control devices 130 and can configure the flow devices 170A as circumstances dictate.

Once configured, the inflow control device 130 during operation downhole produces a pressure drop between the annulus and the string's interior. The pressure drop produced depends on fluid density and fluid viscosity so the device 130 may inhibit water production and encourage hydrocarbon production by backing up water from being produced and breaking up any produced fines. In particular, the flow ports 164 and/or the valve's orifices 182 can be relatively insensitive to viscosity differences in fluid flow therethrough and are instead sensitive to the density of the fluid. When fluid is produced from the borehole, the produced fluid flows through the open valves 180A, which create a pressure drop that keeps the higher density of water backed up. If a water breakthrough event does occur during production, the inflow control device 130 will preferentially produce the hydrocarbon in the produced fluid rather than water.

The flow ports 164 of the flow devices 170A are also preferably defined axially along the basepipe 110 so fluid flow passes parallel to the basepipe's axis, which evenly distributes flow along the production string. In the end, the inflow control device 130 can adjust an imbalance of the inflow caused by fluid-frictional losses in homogeneous reservoirs or caused by permeability variations in heterogeneous reservoirs.

In summary, the inflow control device 130 mounted adjacent the jacket 120 on the completion screen joint 100 can control the flow of produced fluid. During operation, fluid flow from the borehole annulus directs through the screen jacket 120, and screened fluid passes along the basepipe 110 in the annular gap to the device 130. Reaching the end of the jacket 120, the flow of the screened fluid directs through the open end-ring 140 to the inflow control device 130, where the open flow devices 170A restrict the flow of the screen fluid to the flow openings 118 in the basepipe 110.

Figure 5:
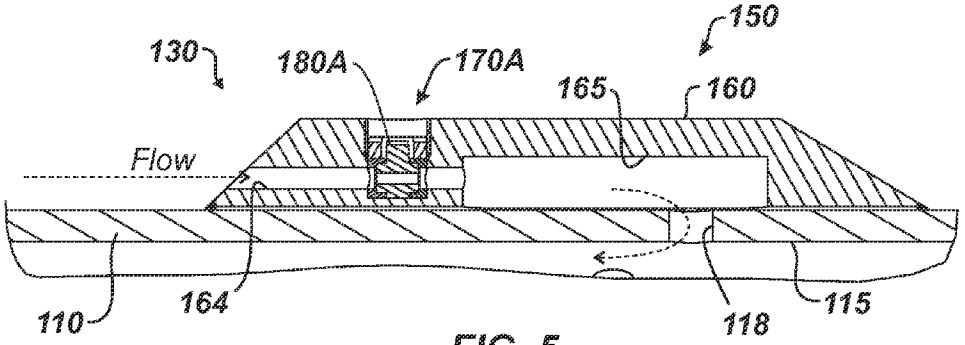
FIG. 5 illustrates an alternative inflow control device for a basepipe.

In the arrangement discussed above, the inflow control device 130 is used on a joint 50 adjacent the end of a screen 120. FIG. 5 shows an alternative arrangement of a basepipe 110 having an inflow control device 130 but does not use a screen. (The same reference numerals are used in FIG. 5 for like elements in the arrangement above so that the description of those elements is not repeated here.) Instead, the inflow control device 130 disposed on the basepipe 110 receives fluid surrounding the basepipe 110 without screening it. Such an arrangement may be used in some completions where sand control is not an issue. If needed, a trap or other filter (not shown) could be used to achieve some filtering of the fluid. During operation, the surrounding fluid passes through selected flow ports 164 in the flow ring 160 if the externally configurable valves 180A of the selected flow devices 170A are configured open. Passing the open valves 180A, the fluid enters into an inner chamber 165 formed in the flow ring 160. All of the flow ports 164 can communicate with its own inner chamber 165, or each can communicate with a common inner chamber 165. From there, the flow enters the basepipe 110 through the openings 118.

Figure 1:
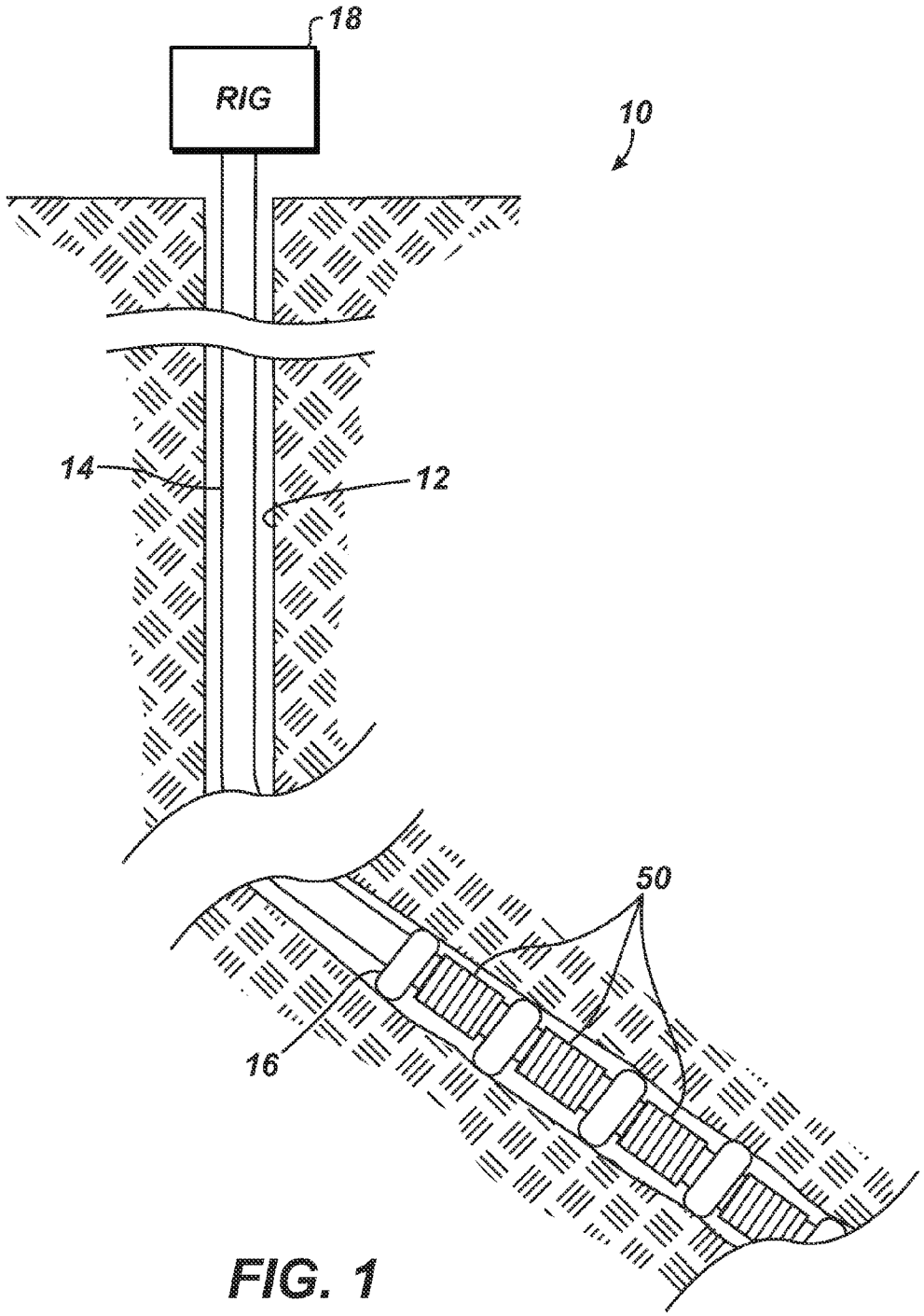
FIG. 1 (Prior Art)
FIG. 1 illustrates a completion system having completion screen joints deployed in a borehole.
Figures 1, 6A:
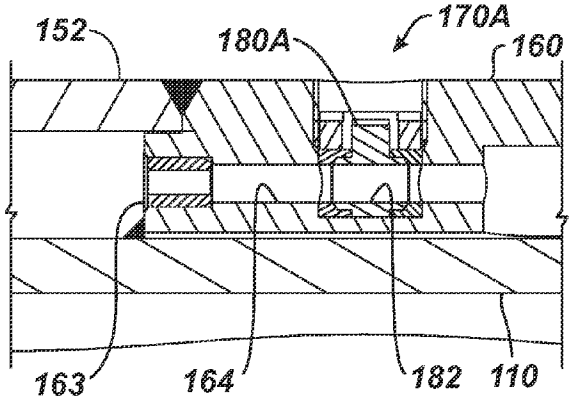
FIGS. 6A-6D illustrate portions of an inflow control device using other valve mechanisms for the flow devices.
Figures 2, 6A:
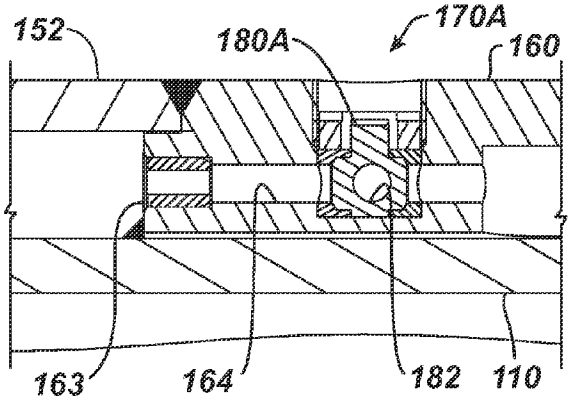

In previous arrangements, the valves 180A have incorporated a flow restriction so that the orifice 182 acts as a nozzle to restrict fluid flow through the flow port 164. As an alternative, the flow restriction may be separate from the valve used to control flow through the flow port 164. For example, FIGS. 6A-1 and 6A-2 show a portion of the flow ring 160 as in the arrangement of FIGS. 4-5 with the valve 180A open (FIG. 6A-1) and closed (FIG. 6A-2). In contrast to the previous valves 180A, the valve 180A for this flow device 170A in FIGS. 6A-1 and 6A-2 defines an orifice 182 that is essentially the same size as the flow port 164. To restrict flow, the flow port 164 instead includes a flow nozzle 163 separate from the valve 180A. This same arrangement can be used with other valves disclosed herein and not just the particular ball type valve 180A depicted here.

In the arrangements described above, the flow devices 170A used ball-type valves 180A that can rotate in external openings 167 in the housing 150 to open or close fluid flow through a flow port 164. Other types of valves and closure mechanisms can be used, including, but not limited to, gate-type valves, butterfly-type valves, and pin or plug mechanisms.

Figures 1, 6B:
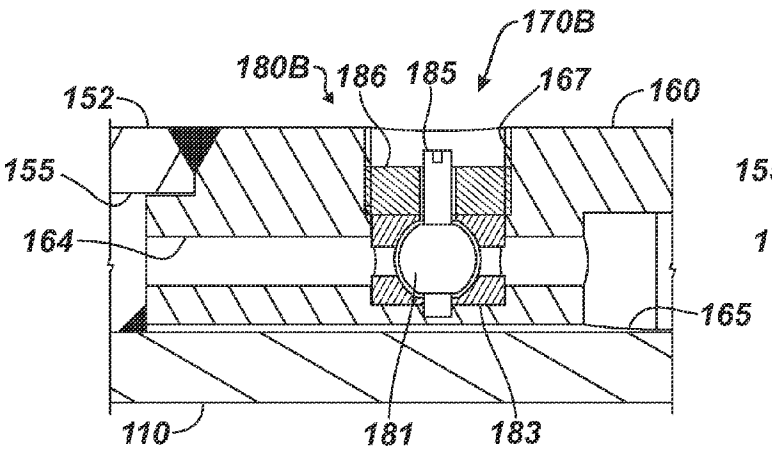
Figures 2, 6B:
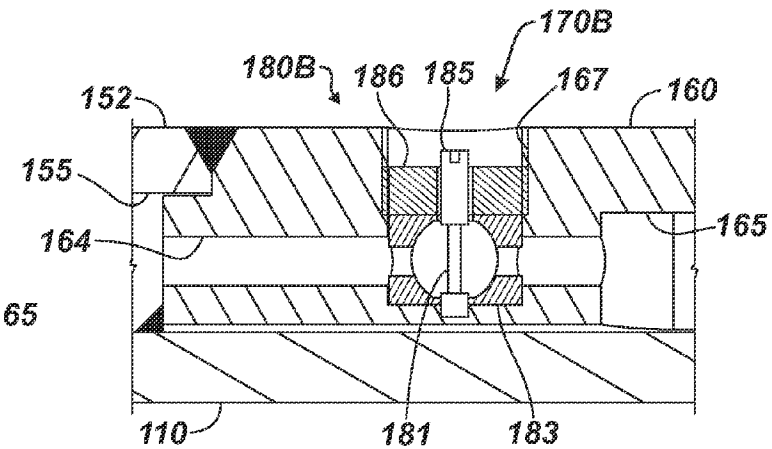

For example, FIGS. 6B-1 and 6B-2 show a portion of a flow device 170B for an inflow control device (130). Here, the flow device 170B uses a butterfly-type valve mechanism, which is shown open (FIG. 6B-1) and closed (FIG. 6B-2). A butterfly valve 180B has a disc or flapper 181 mounted on a rod or spindle 185 used to rotate the flapper 181 relative to an orifice for a flow passage. Here, the orifice uses a flow nozzle 183 in which the flapper 181 is mounted to rotate.

For assembly, the flow device 170B can be constructed in a number of ways. Briefly, the flow nozzle 183 can have mating components that hold the flapper 181 and spindle 185 therein, and the assembly can fit in the housing's external opening 167 to be held therein by a retainer 186 threaded into the opening 167. Many other forms of assembly can be used.

The distal end of the spindle 185 extends beyond the retainer 186 so the flapper 181 can be rotated inside an open space of the nozzle 183. With the flapper 181 turned in-line with the flow passage as shown in FIG. 6B-1, fluid can pass through the nozzle 183, which restricts the fluid flow and creates a pressure drop. With the flapper 181 turned face-on with the flow passage as shown in FIG. 6B-2, the flapper 181 can close off flow through the nozzle 183.

Figures 2, 6C:
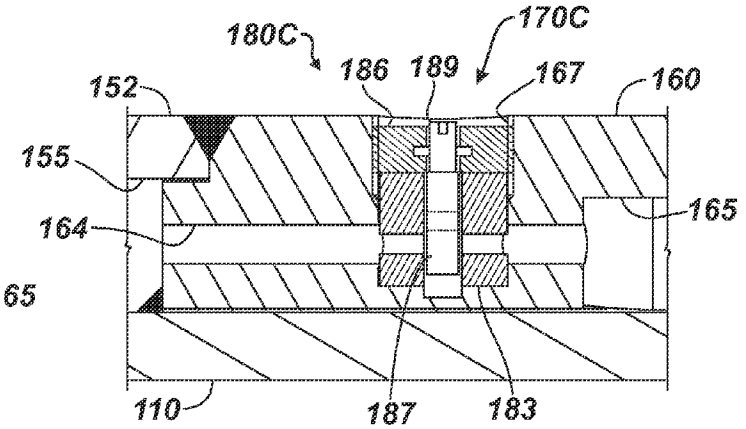
Figures 1, 6C:
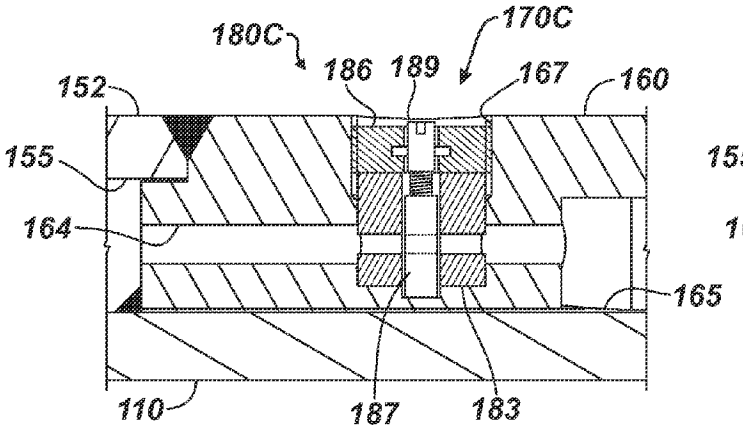

FIGS. 6C-1 and 6C-2 show a portion of another flow device 170C that uses a gate-type valve mechanism, which is shown open (FIG. 6C-1) and closed (FIG. 6C-2). A gate valve 180C has a plate or gate 187 movable relative to an orifice for a flow passage. Again, the orifice uses a flow nozzle 183 in which the gate 187 is mounted to move, and the nozzle 183 can be assembled in a similar manner as above and held by a retainer 186. Adjustment of the gate 187 inside the nozzle 183 relative to the nozzle 183 can alter the flow of fluid that can pass through the nozzle 183. The adjustment uses a screw 189 threaded into the gate 187 so that turning of the screw 189 raises or lowers the gate 187 on the length of the screw 189 to adjust the resulting flow passage through the nozzle 183.

With the gate 187 moved down in the nozzle 183 as shown in FIG. 6C-1, flow can pass through an opening in the gate 187 as the flow passes through the nozzle 183. With the gate 187 moved up in the nozzle 183 as shown in FIG. 6C-2, the gate 187 blocks passage of the flow through the nozzle 183. The gate valve 180C as well as the butterfly valve 180B above can be further configured to produce percentages of flow when the valves 180B-C are externally adjusted because the valves 180B-C can adjust the size of the resulting flow passage through them. Moreover, the valves 180B-C would preferably be erosion resistant. To facilitate illustration of the valves 180B-C, various seals, tight clearances, and other details of the valve mechanisms for the flow devices 170B-C are not shown, but would be present in a given implementation as will be appreciated.

Figures 2, 6D:
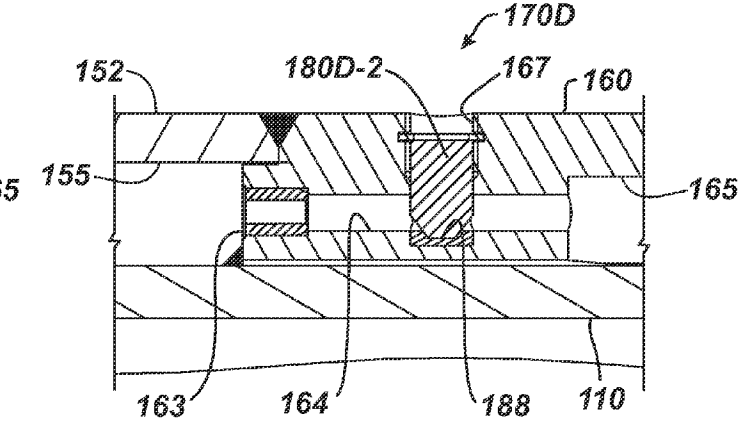
Figures 1, 6D:
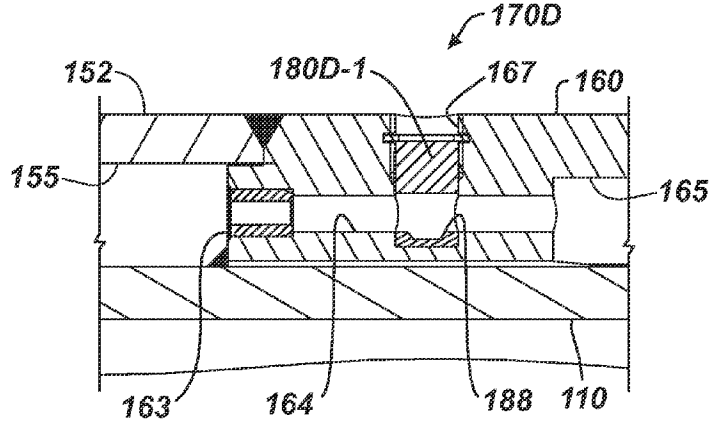

As noted above, other closure mechanisms can be used in flow devices 170 of an inflow control device 130 of the present disclosure. To that end, FIGS. 6D-1 and 6D-2 show a portion of another flow device 170D that uses a plug-type valve mechanism, which is shown open (FIG. 6D-1) and closed (FIG. 6D-2). A first pin or plug 180D-1 disposes in the external opening 167, but does not close off the flow port 164. For example, the first plug 180D-1 does not engage against a lower seat 188 disposed in the flow port 164. The first plug 180D-1 can thread into the external opening 167 and may be held by a spring clip (not labeled) and sealed by sealing elements (not shown). Again, a flow nozzle 163 is used in the flow port 164 to restrict flow. To adjust the restriction possible for the device 170D in the open condition, different sized first plugs 180D-1 can be used to limit the passage of flow in the flow port 164.

To close the device 170D as shown in FIG. 6D-2, a second pin or plug 180D-2 disposes in the external opening 167 and engages against the lower seat 188 to close off the flow port 164. As before, this plug 180D-2 can thread into the external opening 167 and may be held by a spring clip (not labeled) and sealed by sealing elements (not shown). To facilitate illustration of the plugs 180D-1 and 180D-2, various seals, tight clearances, and other details of the mechanisms for the flow device 170D are not shown, but would be present in a given implementation as will be appreciated.

Continuing with alternate forms of flow devices, FIGS. 7A-7D illustrate another completion screen joint 100 having another inflow control device 130 according to the present disclosure in partial cross-section, detail, perspective, and end-section. (Many of the components of the joint 100 and the device 130 are similar to those described above so that their description is not repeated here.) This inflow control device 130 has flow devices 170D that use a closure mechanism having a changeable stopper and cap arrangement rather than an adjustable valve as described above to control the flow of fluid through the device 130.

Here, the opposing end of the screen jacket 120 has a closed end-ring 125. Screened fluid from the jacket 120 therefore passes through an open end-ring 140 and enters a single housing chamber 155. The flow devices 170D then control the flow of fluid from the housing chamber 155 to inner chambers or pockets 165 in communication with the pipe's openings 118. In particular, flow ports 164 defined in the housing's flow ring 160 can communicate the fluid with the inner chambers 165, and the flow devices 170D can be externally configured to selectively open or close fluid communication through these flow ports 164.

Figure 7A:
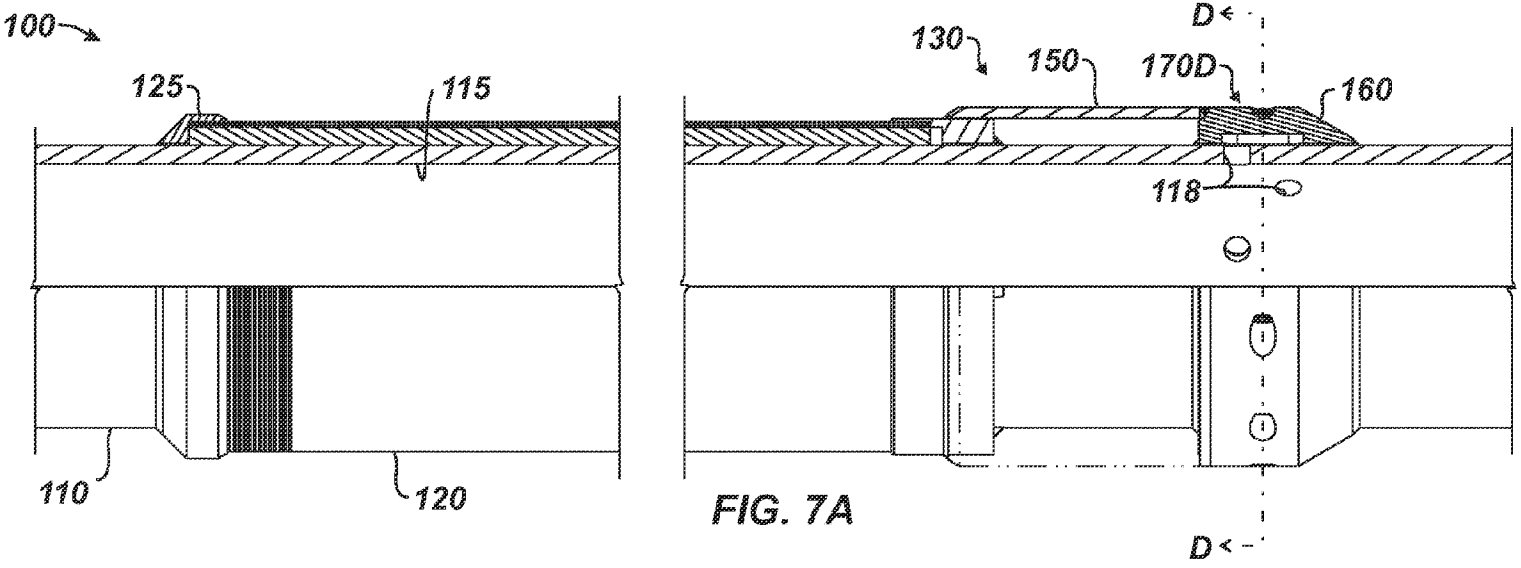
FIGS. 7A-7D illustrate a completion screen joint having another inflow control device according to the present disclosure in partial cross-section, detail, perspective, and end-section.
Figure 7B:
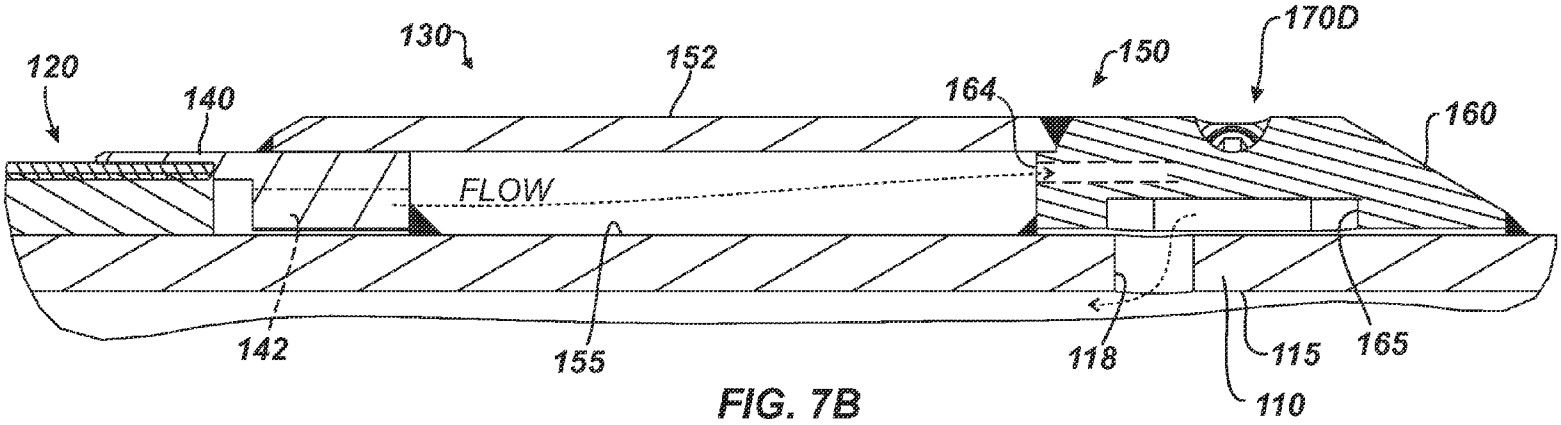
Figure 7C:
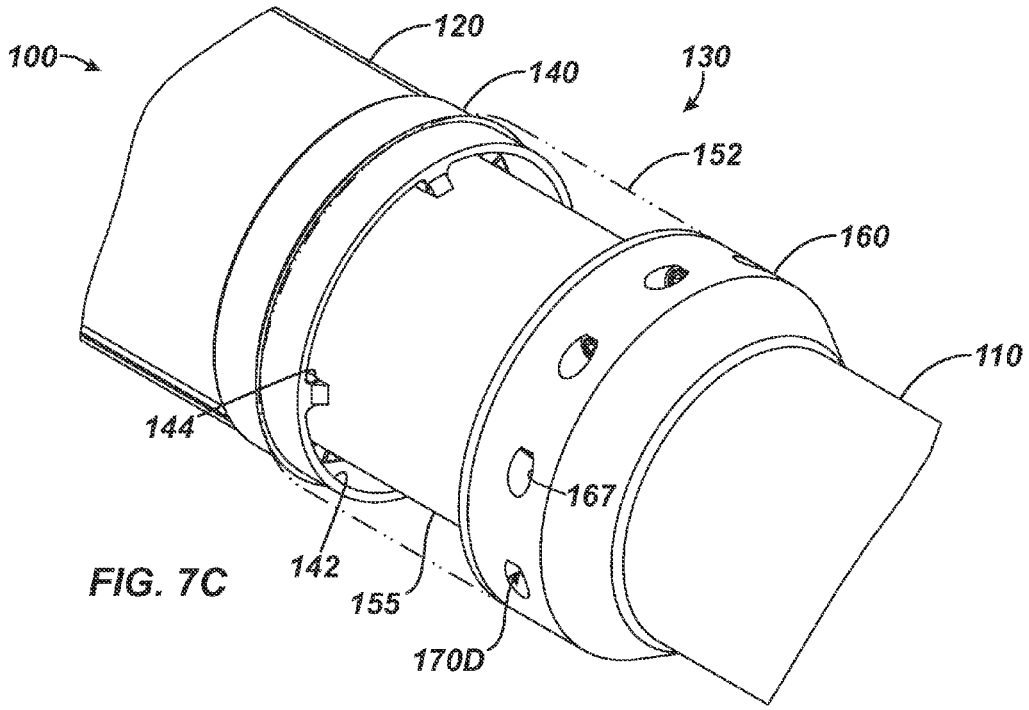
Figure 7D:
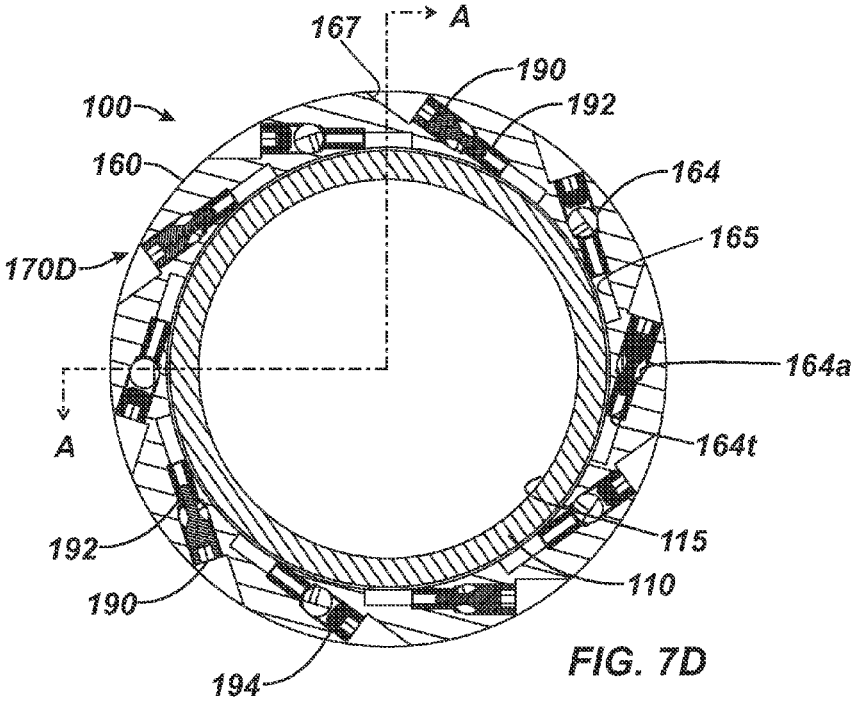
Figure 8A:
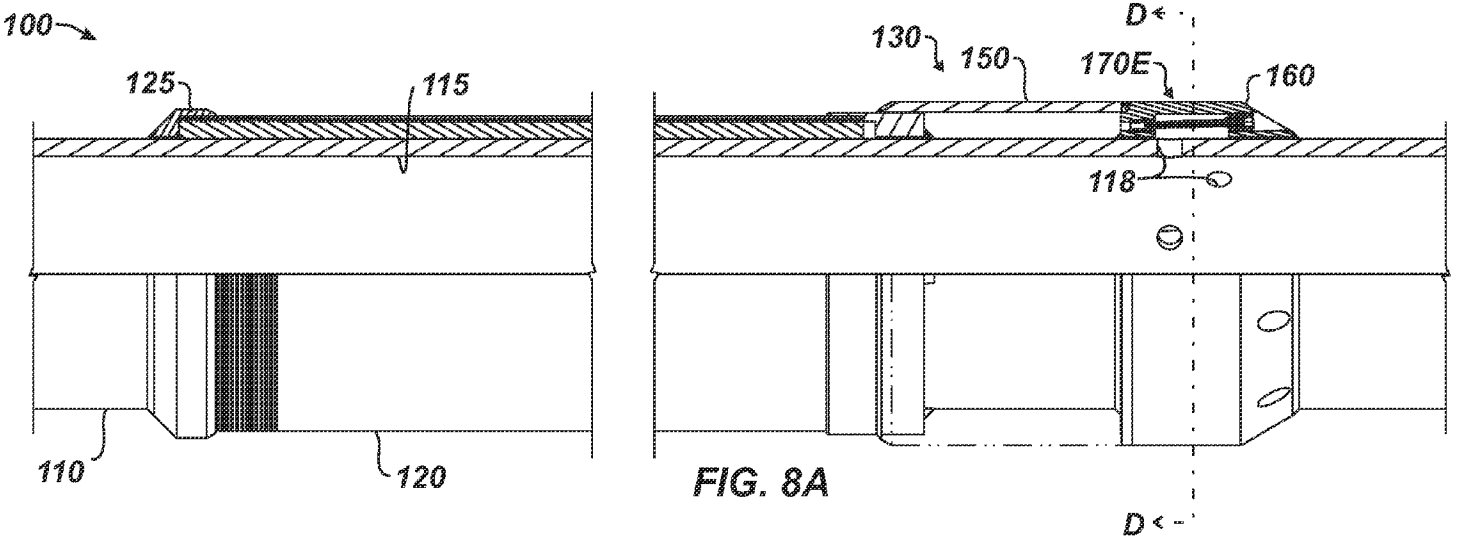
FIGS. 8A-8D illustrate a completion screen joint having yet another inflow control device according to the present disclosure in partial cross-section, detail, perspective, and end-section.
Figure 8B:
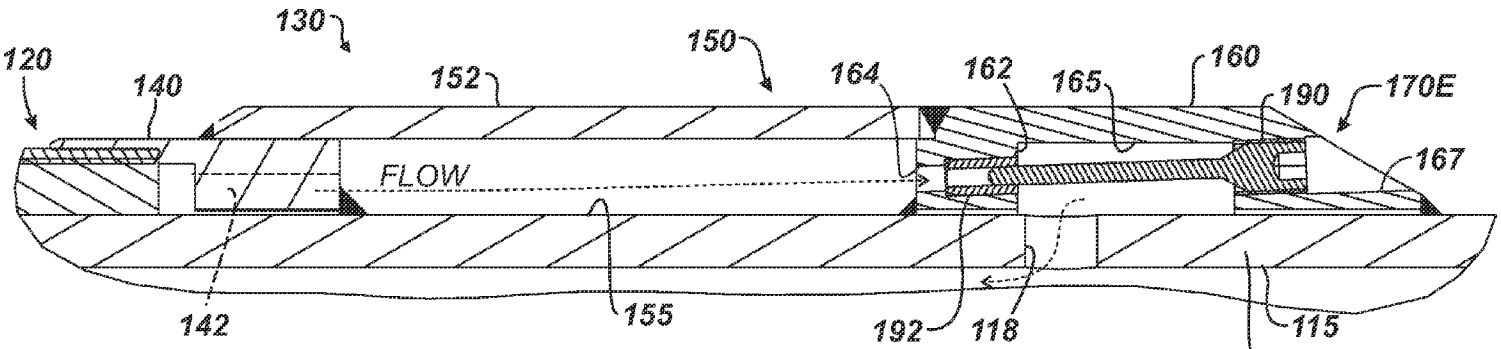
Figure 8C:
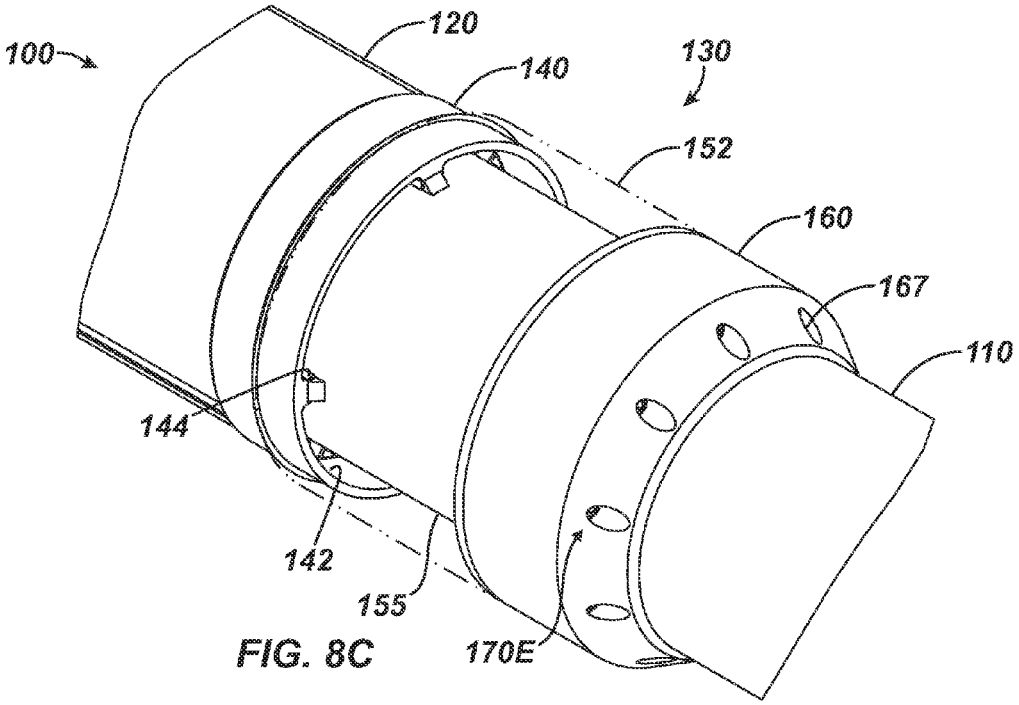
Figure 8D:
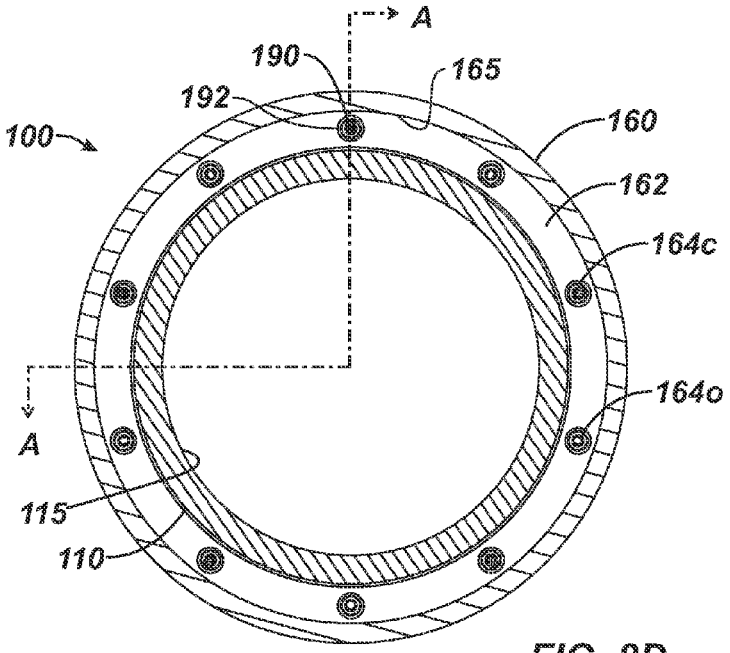

In the flow ring 160 shown in FIG. 7D, each flow port 164 has an axial portion 164*a* and a tangential portion 164*t*. The axial portion 164*a* receives flow from the housing chamber (155: FIG. 7B), and the tangential portion 164*t* communicates the flow to the inner chamber 165 associated with the flow port 164. Accessible via an external opening 167, a pin 190 threads into the opening 167 so that the pin's distal end engages an element 192 disposed in the tangential portion 164*t*. Although a pin 190 is shown, any other stopper, plug, rod, screw, or the like can be used.

When the pin 190 is inserted and threaded, flow through the port 164 is closed. When the pin 190 is absent and the external opening 167 is instead closed off with a cap 194, the flow device 170D is open, and flow passing through the flow port 164 can enter the inner chamber 165. As indicated, the pin 190 and cap 194 can thread into the external opening 167, but they can affix therein in other ways as well. The element 192 in the flow port 164 can serve the dual purposes of a nozzle for restricting flow and a seal for engaging the pin 190. Threading the pin 190 in the external opening 167 pushes the pin's distal end into the element 192 to close off fluid flow. Left alone without the pin 190, however, the element 192, which is preferably composed of an erosion-resistant material, acts as a nozzle for restricting flow of the screened fluid through the flow port 164 and for creating a pressure drop.

In another example, FIGS. 8A-8D illustrate a completion screen joint 100 having yet another inflow control device 130 according to the present disclosure in partial cross-section, detail, perspective, and end-section. (Many of the components of the joint 100 and device 130 are similar to those described above so that their description is not repeated here.) In this inflow control device 130, the flow devices 170E use a similar pin and cap arrangement as above, but the flow ports 164 are arranged in-line rather than being arranged tangentially. To improve external access, the in-line flow ports 164 are preferably offset from the major axis of the joint 100 by a slight angle (e.g., 2°) as shown.

As indicated above, a pin 190 for the flow device 170E is accessible via an external opening 167. The pin 190 threads into the opening 167 so that the pin's distal end engages a seal/nozzle element 192 disposed in the flow port 164. When the pin 190 is inserted and threaded, flow through the port 164 is closed. When the pin 190 is absent, the external opening 167 can be closed off with a cap (e.g., 194: FIG. 7D) so flow can pass through the flow port 164 and not out the external opening 167.

Figure 9A:
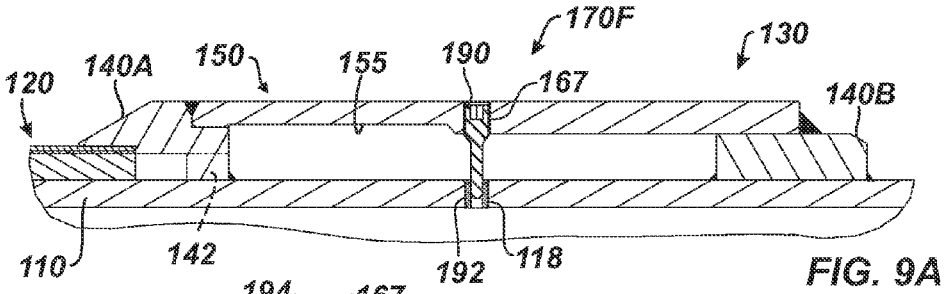
FIG. 9A illustrates an inflow control device in cross-section having a pin and cap arrangement.

FIG. 9A illustrates an inflow control device 130 in cross-section having flow devices 170F utilizing yet another pin and cap arrangement. This inflow control device 130 is mounted adjacent a screen jacket 120 and uses a chamber 155 in fluid communication with the screen jacket 120. (Again, many of the components of the inflow control device 130 are similar to those described above so that their description is not repeated here.)

Figure 9B:
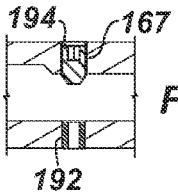
FIG. 9B shows a cap installed in the housing's opening for the pin and cap arrangement of FIG. 9A.

In this arrangement, fluid from the jacket 120 feeds into the chamber 155 by passing through the openings 142 in the open end-ring 140. Once in the chamber 155, the screened fluid flows through open flow devices 170F disposed in the openings 118 of the basepipe 110. In this configuration, these flow devices 170F restrict flow of the fluid from the housing chamber 155 directly through the openings 118. To control flow, these flow devices 170F can have dual seal/nozzle elements 192 and pins 190 as in the arrangements described above. The pins 190 are accessible from outside the housing 150 so that the device 130 can be configured externally. For those nozzles 192 intended to remain open, operators instead install a cap 194 in the housing's opening 167 as shown in FIG. 9B.

The basepipe openings 118 can have ten flow devices 170F so that the flow from the jacket 120 can feed through one to ten flow devices 170F depending upon how the flow devices 170F are configured. Because the chamber 155 is at reservoir pressure, the cap 194 of FIG. 9B used here in this arrangement may not need to be more robust than in other arrangements. With appropriate modification provided with the benefit of the present disclosure, a valve mechanism such as discussed above could be used in the position of FIG. 9A.

Figure 10:
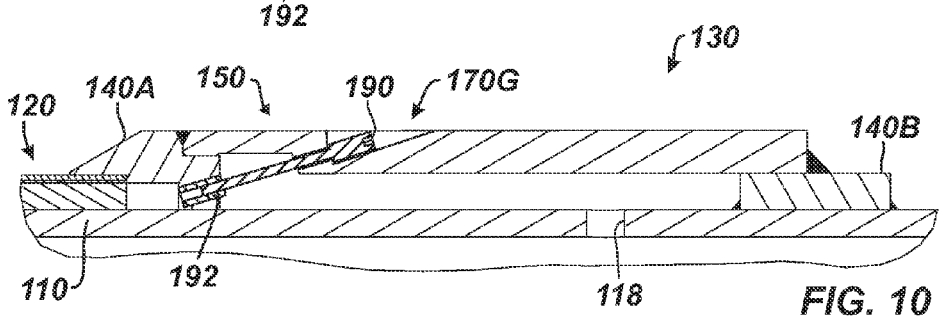
FIG. 10 illustrates an inflow control device in cross-section having another pin and cap arrangement.

An alternative is shown in FIG. 10. Here, the flow devices 170G are in the open end-ring 140 to restrict the flow of the screened fluid directly from the screen jacket 120 into the housing chamber 155, where the flow can then pass through the openings 118. The pins 190 again insert from outside the housing 150 into the nozzles/seal elements 192 to close off fluid flow. For those nozzles 192 intended to remain open, operators instead install caps (194: FIG. 9B) as before in the housing's openings 167.

Although these flow devices 170G use the pin and cap arrangement to control fluid flow through nozzles 192, it will be appreciated with the benefit of the present disclosure that a flow device 170 incorporated into an end-ring 140 (as in FIG. 10) can use any one of the valve mechanisms (e.g., valves 180A-C) discussed above.

Figure 11:
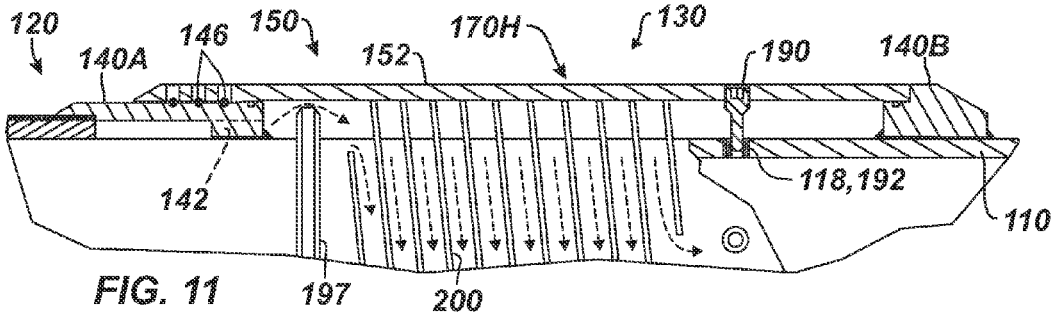
FIG. 11 illustrates an inflow control device in cross-section having a pin and cap arrangement for a tortuous pathway.
Figure 12:
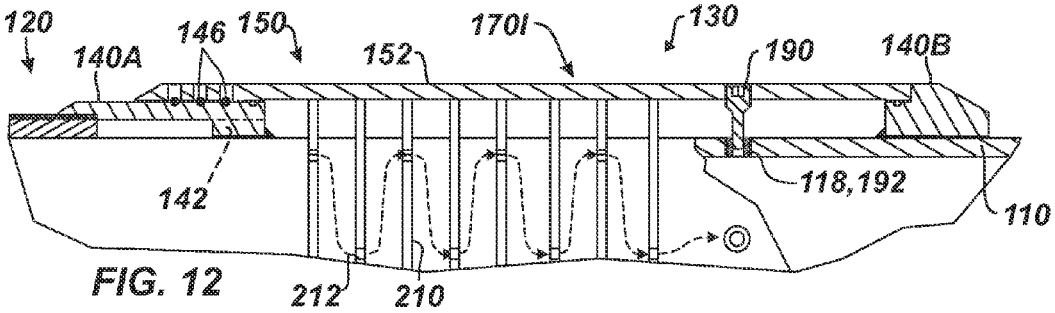
FIG. 12 illustrates an inflow control device in cross-section having a pin and cap arrangement for another tortuous pathway.

In the implementations above, the inflow control devices 130 have used flow ports 164, nozzles 192, and/or valve mechanisms to control and restrict fluid communication to the pipe's openings 118 and create the desired pressure drop. Additional features can be used to control flow and create the pressure drop, including a constricted orifice, a tube, a syphon, or other such feature. As shown in FIGS. 11-12, for example, the inflow control device 130 can utilize convoluted channels or tortuous pathways to control and restrict fluid communication from a housing chamber 155 to the pipe's openings 118.

In FIG. 11, the inflow control device 130 utilizes a spiraling rib 200 disposed on the basepipe 110 for a convoluted channel or tortuous pathway to control and restrict flow of screened fluid from the screen jacket 120. The rib 200 is disposed on the basepipe 110 adjacent the pipe's openings 118 and reaches to the inside of the housing 150. A restricting ring 197 may create an initial narrow annulus to restrict the flow as well. (As an alternative to the rib 200, a tortuous pathway may use a plurality of these restricting rings 197.)

The openings 118 in this arrangement have elements 195 that can be sealed externally with a pin 190 as shown for this flow device 170H. (These elements 195 act as seal elements and can be nozzles, although they may not need to be.) For those openings 118 that are to remain open, the external openings 167 in the housing 150 can be closed with a cap (194: FIG. 9B) as before, which leaves the associated opening 118 open for flow into the basepipe's bore 115.

In FIG. 12, the inflow control device 130 also utilizes a plurality of ribs 210 for a convoluted channel or tortuous pathway formed in the inflow control device 130. Here, the ribs 210 disposed on the basepipe 110 create segmented pockets or chambers, and slots 212 in the ribs 210 restrict fluid flow between the chambers. Again, the ribs 210 are disposed on the basepipe 110 adjacent the pipe's openings 118 and reach to the inside of the housing 150. The openings 118 in this arrangement also have elements 195 (that may or may not be a nozzle) that can be sealed with a pin 190 as shown for this flow device 170I. For those nozzles 192 that are to remain open, the external openings 167 in the housing 150 can be closed with a cap (194: FIG. 9B) as before, which leaves the associated nozzle 192 open for flow to the basepipe's bore.

In the inflow control devices 130 of FIGS. 11-12, a convoluted channel or tortuous pathway is constructed for the flow from the screen jacket 120. The housing 150 for these devices 130 may be removable from the basepipe 110 as shown, using a sleeve 152 engaging one end-ring 140B and affixing to the other end-ring 140 with lock wires 146. Other inflow control devices 130 disclosed herein may also have removable housings; although as expressed above, this may not be necessary.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

Any of the various flow devices 170 disclosed herein for one of the inflow control devices 130 can be substituted by any of the other flow devices 170. Additionally, any of the various flow devices 170 for one of the inflow control devices 170 can be used in combination with any of the other flow devices 170 so that a hybrid arrangement of the flow devices 170 can be used on the same inflow control device 130.

In the present description, the inflow control devices 130 have been disclosed as including flow devices 170 to control flow of screened fluid from the borehole to the bore of a tubing string. As to be understood herein, the inflow control devices 130 are a form of flow device and can be referred to as such. Likewise, the flow devices 170 are a form of inflow control devices and can be referred to as such.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A flow control apparatus for a borehole, comprising:

a basepipe having a bore for conveying fluid and defining at least one opening for communicating fluid into the bore;

at least one flow device disposed on the basepipe and defining a plurality of flow ports, the flow ports communicating fluid from outside the basepipe to the at least one opening defined in the basepipe, each of the flow ports being intersected by a respective one of a plurality of external openings exposed on an exterior of the at least one flow device;

a plurality of internal valves, each of the internal valves being selectively inserted into the external openings and interposing the respective one of the flow ports disposed inside the at least one flow device, each of the internal valves having at least an external portions of the internal valves being externally accessible from the exterior of the at least one flow device; and a plurality of fixture portions respectively threading in the external openings and holding the respective internal valve in the external openings, each of the internal valves inserted into one of the external openings being configurable between first and second states relative to the respective flow port with movement of the external portion, each of the internal valves configured between the first and second states selectively controlling flow of the fluid via the respective flow port from outside the basepipe to the at least one opening defined in the basepipe.

2. The apparatus of claim 1, further comprising a screen disposed on the basepipe, the screen screening the fluid from outside the basepipe and communicating the fluid with the at least one flow device.

3. The apparatus of claim 1, wherein each of the internal valves in the first state is configured in an open condition permitting fluid communication to the at least one opening, and wherein each of the internal valves in the second state is configured in a closed condition preventing fluid communication to the at least one opening.

4. The apparatus of claim 1, wherein at least one of the flow ports restricts the flow of the fluid.

5. The apparatus of claim 4, wherein the at least one flow port comprises a nozzle disposed in the at least one flow port, the nozzle restricting the flow of the fluid.

6. The apparatus of claim 1, wherein the at least one flow device or at least one of the internal valves comprises means for producing a pressure drop in the flow of the fluid.

7. The apparatus of claim 1, wherein the at least one flow device comprises:

a first end in fluid communication with the fluid from outside the basepipe; and a second end in fluid communication with the at least one opening.

8. The apparatus of claim 7, wherein the first end comprises a first end-ring defining a fluid passage in fluid communication with the fluid from outside the basepipe, and wherein the second end comprises a second end-ring.

9. The apparatus of claim 8, wherein the second end-ring defines the flow ports communicating with the at least one opening.

10. The apparatus of claim 9, wherein the flow ports each comprises a nozzle restricting the flow of the fluid.

11. The apparatus of claim 8, wherein the at least one flow device comprises a sleeve affixed to the first and second end-rings and defining a chamber with the first and second end-rings.

12. The apparatus of claim 1, wherein the internal valves comprise a ball valve having an orifice defined therein and being rotatable relative to the flow port interposed thereby, the rotation of the ball valve being externally accessible with the external portion on the exterior of the at least one flow device and changing fluid communication through the flow port.

13. The apparatus of claim 12, wherein the ball valve comprises a rotatable body disposed in the external opening in the at least one flow device, the rotatable body having the orifice therethrough and being rotatable relative to the flow port, the rotatable body having a spindle as the external portion extending therefrom, the spindle being accessible externally in the external opening in the at least one flow device for rotating the rotatable body.

14. The apparatus of claim 13, wherein the ball valve comprise seal elements disposed inside the external opening against the rotatable body.

15. The apparatus of claim 14, wherein the orifice of the ball valve in the first state produces a pressure drop in the flow of the fluid therethrough.

16. The apparatus of claim 1, wherein the internal valves comprise a gate valve having a gate movable relative to the flow port interposed thereby, the movement of the gate being externally accessible with the external portion on the exterior of the at least one flow device and changing fluid communication through the flow port.

17. The apparatus of claim 16, wherein the gate valve comprises a body disposed in the external opening in the at least one flow device, the body having an orifice therethrough in communication with the flow port, the gate disposed in the body and being movable relative to the orifice, the gate having a screw as the external portion extending therefrom, the screw being accessible externally in the external opening in the flow device for moving the gate.

18. The apparatus of claim 1, wherein the internal valves comprise a butterfly valve having a flapper rotatable relative to the flow port interposed thereby, the rotation of the flapper being externally accessible with the external portion on the exterior of the at least one flow device and changing fluid communication through the flow port.

19. The apparatus of claim 18, wherein the butterfly valve comprises a body disposed in the external opening in the at least one flow device, the body having an orifice therethrough in communication with the flow port, the flapper disposed in the body and being rotatable relative to the orifice, the flapper having a spindle as the external portion extending therefrom, the spindle being accessible externally in the external opening in the at least one flow device for rotating the flapper.

20. The apparatus of claim 1, wherein the internal valves each define a respective flow restriction when in the first state, each of the internal valves inserted in the external openings selectively configuring the respective flow restriction of the fluid for the respective flow port.

21. The apparatus of claim 20, wherein at least two of the internal valves for interposing in the external openings include first and second of the respective flow restrictions being different from one another.

22. The apparatus of claim 1, wherein each of the internal valves comprises a body disposed in the respective external opening; and wherein each of the fixture portions comprises a retainer in the respective external opening and holding the body therein.

23. A flow control method for a borehole, comprising:

inserting each of a plurality of internal valves into a respective one of external openings on an exterior of a housing on a basepipe;

holding each of the inserted internal valves in the respective external opening by threading a respective fixture portion in the respective external openings;

interposing each of the inserted internal valves in a respective one of a plurality of flow ports disposed inside the housing;

selectively configuring each of the internal valves disposed in the housing on the basepipe and interposing the respective flow port by externally accessing at least an external portion of the each internal valve from the exterior of the housing and selectively opening or closing fluid communication through the respective flow port interposed thereby;

deploying the basepipe in the borehole;

receiving fluid in the housing from outside the basepipe; and controlling flow of the received fluid to one or more internal openings in the basepipe using the configured internal valves.

24. The method of claim 23, wherein controlling the flow of the received fluid to the one or more internal openings comprises restricting the flow of the received fluid through one or more of the internal valves configured in an open condition.

25. The method of claim 24, wherein restricting the flow of the received fluid through the one or more internal valves configured in the open condition comprises producing a pressure drop in the flow of the received fluid through the one or more internal valves configured in the open condition.

26. The method of claim 23, wherein selectively configuring each of the internal valves comprises rotating a ball valve disposed inside the housing relative to the flow port interposed thereby, the rotation of the ball valve being externally accessible with the external portion on the exterior of the housing and changing fluid communication through the flow port.

27. The method of claim 26, wherein rotating the ball valve comprises accessing a spindle as the external portion extending in the external opening in the housing and rotating a rotatable body with the spindle, the rotatable body having an orifice therethrough and being rotatable relative to the flow port interposed thereby.

28. The method of claim 27, wherein rotating the ball valve comprises sealing the rotatable body inside the external opening.

29. The method of claim 27, comprising producing a pressure drop in the flow of the fluid through the orifice of the ball valve in an opened state.

30. The method of claim 23, wherein selectively configuring each of the internal valves comprises moving a gate valve disposed inside the housing relative to the flow port interposed thereby, the movement of the gate valve being externally accessible with the external portion on the exterior of the housing and changing fluid communication through the flow port.

31. The method of claim 30, wherein moving the gate valve comprises accessing a screw as the external portion extending in the external opening of the housing, and moving a gate in the external opening using the screw.

32. The method of claim 23, wherein selectively configuring each of the internal valves comprises rotating a butterfly valve disposed inside the housing relative to the flow port interposed thereby, the rotation of the butterfly valve being externally accessible with the external portion on the exterior of the housing and changing fluid communication through the flow port.

33. The method of claim 32, wherein rotating the butterfly valve comprises accessing a spindle as the external portion in the external opening of the housing, and rotating a flapper in the external opening with the spindle.

34. The method of claim 23, wherein the internal valves each define a respective flow restriction; and wherein inserting the internal valves into the external openings on the exterior of the housing on the basepipe comprises selecting each of the internal valves based on the respective flow restriction of the internal valves for the fluid flow in the flow ports.

35. The method of claim 23, wherein each of the internal valves comprises a body; wherein each of the fixture portions comprises a retainer; and wherein threading the respective fixture portion in the respective external opening comprises threading the retainer in the respective external opening to hold the body of the internal valve therein.

* * * * *